US007326440B2

(12) United States Patent
Tokunaga et al.

(10) Patent No.: US 7,326,440 B2
(45) Date of Patent: Feb. 5, 2008

(54) PROCESS FOR PREPARING AN INK-JET RECORDING MATERIAL

(75) Inventors: Yukio Tokunaga, Chiyoda-ku (JP); Iwao Maekawa, Chiyoda-ku (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 472 days.

(21) Appl. No.: 10/606,360

(22) Filed: Jun. 26, 2003

(65) Prior Publication Data

US 2004/0086665 A1 May 6, 2004

Related U.S. Application Data

(63) Continuation of application No. 10/230,995, filed on Aug. 30, 2002, now abandoned.

(30) Foreign Application Priority Data

Aug. 31, 2001 (JP) ..... 2001-262702
Jul. 9, 2002 (JP) ..... 2002-200323

(51) Int. Cl.
*B05D 5/04* (2006.01)
*B05D 3/12* (2006.01)

(52) U.S. Cl. ..... 427/289; 427/209; 427/293

(58) Field of Classification Search ..... 427/289, 427/293, 209

See application file for complete search history.

(56) References Cited

U.S. PATENT DOCUMENTS 5,008,150 A 4/1991 Ashida et al.
5,328,749 A 7/1994 Noda et al.
6,335,102 B1 1/2002 Tsubaki et al.
6,436,513 B1 8/2002 Kitamura et al.
6,716,492 B1 * 4/2004 Moriya et al. ..... 428/32.1
2001/0014381 A1 * 8/2001 Kaneko et al. ..... 428/195
2003/0008113 A1 * 1/2003 Ohya et al. ..... 428/195
2003/0194539 A1 * 10/2003 Ohya et al. ..... 428/195

FOREIGN PATENT DOCUMENTS

EP 0 903 246 A2 3/1999
EP 1 034 940 A1 9/2000
JP 2000-263926 A * 9/2000

OTHER PUBLICATIONS

JPO computer translation of JP 2000-263926 A, published Sep. 26, 2000.*

* cited by examiner

*Primary Examiner*—Kirsten Jolley
(74) *Attorney, Agent, or Firm*—Paul E. White, Jr.; Manelli Denison & Selter PLLC

(57) ABSTRACT

There is disclosed a sheet-state ink-jet recording material which comprises a water-resistant support and at least one ink-receptive layer provided on the support, wherein at least one of the ink-receptive layers contains inorganic fine particles having an average primary particle size of 30 nm or less and a hydrophilic binder, and a longitudinal direction of the sheet-state ink-jet recording material is cut at a right angle to a flowing direction of the recording material at a time of coating the ink-receptive layer.

9 Claims, 3 Drawing Sheets

PROCESS FOR PREPARING AN INK-JET RECORDING MATERIAL

This is a continuation of application Ser. No. 10/230,995 filed Aug. 30, 2002 now abandoned.

BACKGROUND OF THE INVENTION

1. Field of the Invention

The present invention relates to an ink-jet recording material, more specifically to a sheet-state ink-jet recording material having a photo-like glossiness and the feel of a material like a photograph, and causing no rubbing at a head (a phenomenon of contacting an ink-jet head with a recording sheet) at the time of printing by a printer.

2. Prior art

As a recording material to be used for an ink-jet recording system, a recording material in which an ink-receptive layer comprising a hydrophilic polymer is provided on a paper support, and a recording material in which a porous ink-receptive layer comprising a pigment such as amorphous silica, and a hydrophilic binder is provided on a support have generally been known.

As the former type recording materials, it has been proposed a recording material in which a hydrophilic polymer such as starch, polyvinyl alcohol, etc. is provided on a paper support as disclosed in, for example, Japanese Provisional Patent Publications No. 080489/1981, No. 174381/1984, No. 220750/1985, No. 32788/1986, No. 160875/1988, No. 69388/1991 and the like.

As the latter type recording materials, it has been proposed a recording material in which a silicon-containing pigment such as silica is provided on a paper support with a hydrophilic binder, as disclosed in, for example, Japanese Provisional Patent Publications No. 51583/1980, No. 157/1981, No. 107879/1982, No. 107880/1982, No. 230787/1984, No. 160277/1987, No. 184879/1987, No. 183382/1987, No. 11877/1989, and the like.

Also, in Japanese Patent Publication No. 56552/1991, Japanese Provisional Patent Publications No. 188287/1990, No. 81064/1998, No. 119423/1998, No. 175365/1998, No. 193776/1998, No. 203006/1998, No. 217601/1998, No. 20300/1999, No. 20306/1999 and No. 34481/1999, U.S. Pat. No. 5,612,281, and EP 0 813 978 A, and the like, there have been disclosed ink-jet recording materials using synthetic silica fine particles prepared by a gas phase process (hereinafter referred to as "fumed silica"). Moreover, in Japanese Provisional Patent Publications No. 276671/1990, No. 67684/1991, No. 251488/1991, No. 67986/1992, No. 263983/1992 and No. 16517/1993, there have been disclosed ink-jet recording materials using aluminum hydrates. These fumed silica and aluminum hydrates are ultra fine particles having an average particle size of a primary particle of several nm to several tens nm, and their secondary particle diameters can be easily regulated to 300 nm or less so that they have characteristics of giving high glossiness and high ink-absorption properties.

In recent years, a photo-like recording sheet has earnestly been desired, and the feel of a material, feeling and glossiness close to photography becomes more important. As such a recording material, there has been proposed a recording material in which an ink-receptive layer mainly comprising the above-mentioned fine particles is coated on a water resistant support such as a polyolefin resin-coated paper (a polyolefin resin is coated on the both surfaces of base paper), etc.

In the ink-jet printer corresponding to a photo-like printer, a low-density ink has generally been used alone or in combination with a high-density ink to form a photo-like image. To obtain an image by using such a low-density ink, it is necessary to discharge a large amount of the ink, so that a recording material is required to have high ink-absorption property. A water-resistant support such as a polyolefin resin-coated paper itself does not absorb ink, so that an ink-receptive layer is required to absorb a large amount of ink. Thus, the ink-receptive layer is so designed to contain a large amount of a pigment to absorb the ink.

However, in an ink-jet recording material in which an ink-receptive layer containing a large amount of a pigment is provided by coating, curl (hereinafter referred to as "plus curl") to the direction of a printed surface side tends to be remarkable due to shrinkage of the ink-receptive layer by drying. When the plus curl becomes remarkable, a phenomenon that the recording material and an ink-jet head of a printer are contacted to each other at the time of printing (hereinafter referred to as "head rubbing") frequently occurs. When the head rubbing occurred, not only a printed image is damaged but also the ink-jet head is broken in some cases. The problem of the head rubbing likely occurs when a sheet-state ink-jet recording material having a relatively small size is printed. For example, it causes when a sheet-state recording material having a length of longitudinal direction of 300 mm or less is used, particularly when a sheet-state recording material having a length of longitudinal direction of 200 mm or less.

In recent years, high-speed printing by an ink-jet printer and high quality printed image are required. Accompanying with these requirements, to improve precision of dotted point of ink, clearance of the ink-jet head and the recording material tends to be little. Also, to obtain a printed image close to a photograph printed to a photographic paper, a printer which can carry out printing over the whole surface of a sheet-state recording material, which is so-called "edgeless printing" has been sold. In such a printer, the problem of head rubbing is likely caused.

On the other hand, in Japanese Provisional Patent Publication No. 2000-263926, there is disclosed that at the time of cutting an ink-jet recording material using a paper support to a sheet state, the recording material is so cut that a paper feeding direction through a printer becomes a right angle to a flowing direction of the paper support at the time of making the paper. This technique is to solve the problem of cockling (which is a phenomenon of giving a waved recorded material by swelling of the paper support due to absorption of ink) which is a specific problem in a recording material using the paper support and to solve the problem that a plural number of recording materials are fed to the printer when printing is carried out. Also, in the recording material using a paper support, it is difficult to obtain a photo-like glossiness and the feel of a material (a feel of touching) similar to photographic printing paper. Moreover, a recording material using a paper support involves a problem of likely causing head rubbing due to cockling.

In an ink-jet recording material of using a water-resistant support according to the present invention, the problem of cockling as mentioned above never occurs.

An ink-receptive layer mainly containing inorganic fine particles or containing a large amount of the same shrinks by drying in the course of coating said ink-receptive layer and drying or when a recording sheet as a final product is allowed to stand under low humidity. On the other hand, a water-resistant support scarcely absorbs water content so that a degree of shrinkage is extremely little. Accordingly, in a recording material in which an ink-receptive layer which shrinks by drying is provided on a water-resistant support which difficultly causes elongation or shrinkage likely causes plus curl at the ink-receptive layer side (a printing surface side) whereby causing head rubbing.

SUMMARY OF THE INVENTION

An object of the present invention is to provide a sheet-state ink-jet recording material having a photo-like glossiness and the feel of a material (a feel of touching) similar to photography and causing no head rubbing at the time of printing.

The above objects of the present invention can be accomplished by a sheet-state ink-jet recording material which comprises a water-resistant support and at least one ink-receptive layer provided on the support, wherein at least one of the ink-receptive layers contains inorganic fine particles having an average primary particle size of 30 nm or less and a hydrophilic binder, and a longitudinal direction of the sheet-state ink-jet recording material is cut at a right angle to a flowing direction of the recording material at a time of coating the ink-receptive layer.

DESCRIPTION OF THE PREFERRED EMBODIMENTS

A sheet-state ink-jet recording material (hereinafter abbreviated to as "a recording sheet") of the present invention employs a water-resistant support, so that no ink is absorbed by the support whereby no cockling causes and a photo-like (similar to a photographic printing paper) feel of a material and glossiness can be obtained. However, when a water-resistant support is to be used, it is necessary to absorb all the ink discharged from an ink-jet head (hereinafter abbreviated to as "a head") by the ink-receptive layer, so that it is also necessary to make a coated amount of the ink-receptive layer large and heighten a void ratio. That is, an ink-receptive layer which mainly contains inorganic fine particles with a large amount is required to be provided. When such an ink-receptive layer is provided on a water-resistant support, the ink-receptive layer shrinks by drying as mentioned above whereby plus curl occurs.

The present inventors have found that the above problem can be solved by changing a cutting method which has very conventionally carried out.

Not only an ink-jet recording material but also paper and a processed paper in which a coating liquid is coated on paper are once wound in a jumbo roll (a long rolled paper) in the course of the preparation. Thereafter, in a finishing step (a cutting step), the jumbo roll is cut to a sheet having a product size. In the case of an ink-jet recording material, it is cut to a rectangular shaped sheet.

Figure 1:
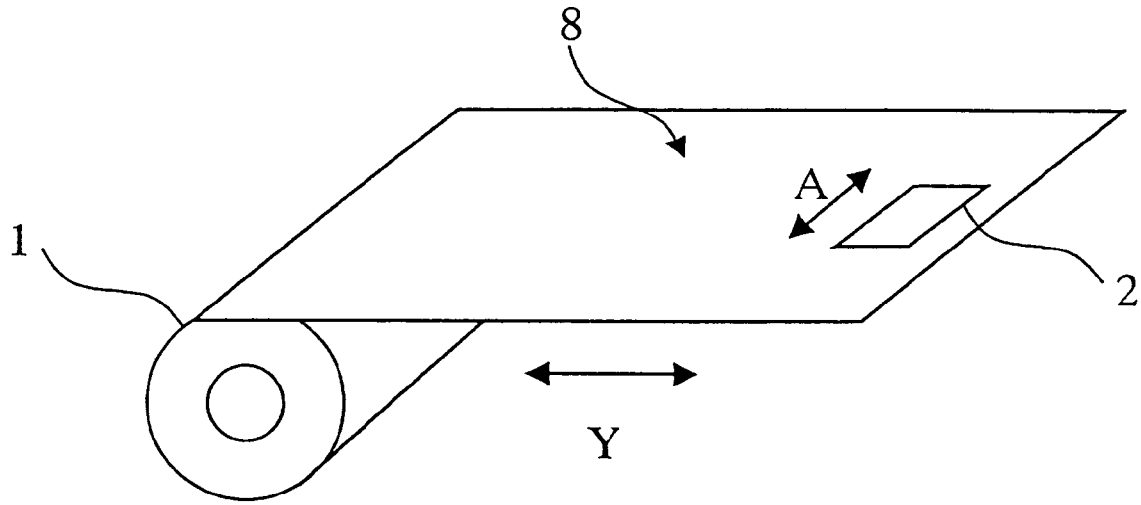
FIG. 1 is a schematic drawing showing a cutting method of the present invention.
Figure 2:
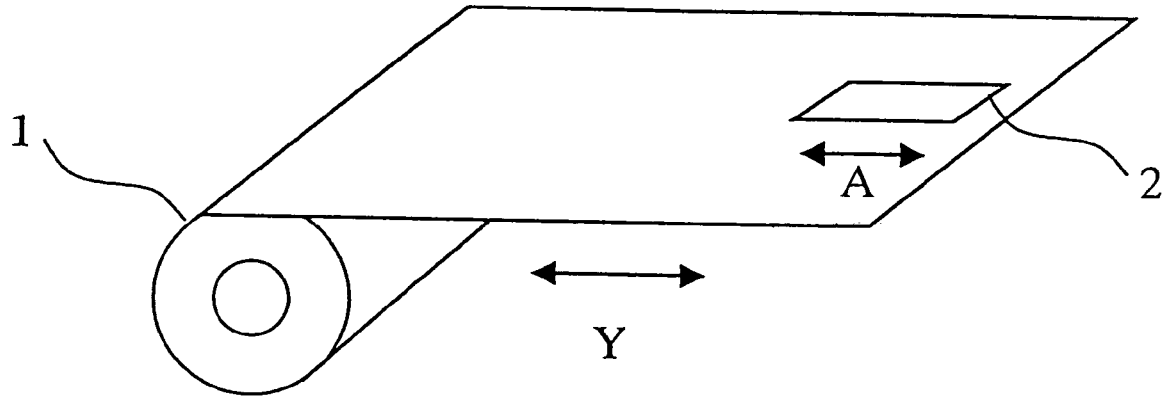
Fig. 2 (Prior art)
FIG. 2 is a schematic drawing showing a general cutting method of the prior art.

Conventional cutting method generally carried out is shown in FIG. 2. A jumbo roll 1 is unwound and cut to a sheet 2 by a cutting device. At this time, a longitudinal direction (A) of the sheet 2 is cut so that it is the same direction to a continuously rolling direction (Y). The above-mentioned continuously rolling direction (Y) corresponds to a flowing direction of an ink-receptive layer at the time of coating. On the other hand, the cutting method of the present invention is carried out as shown in FIG. 1 that the jumbo roll is cut so that a longitudinal direction (A) of the sheet 2 becomes a right angle to a flowing direction (Y) at the time of coating the ink-receptive layer by coating. In FIG. 1, the reference numeral 8 means a side on which the ink-receptive layer is provided.

Figure 3:
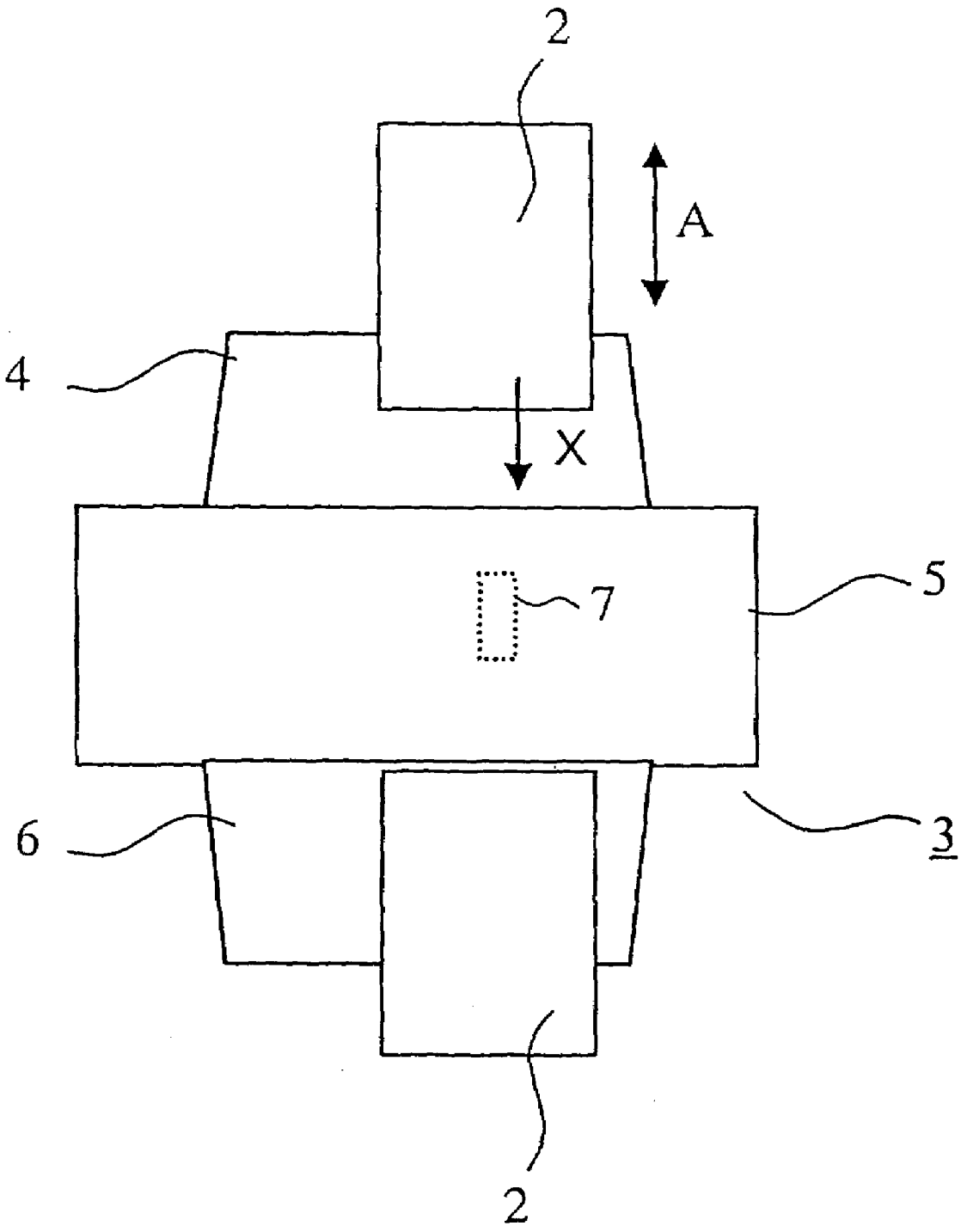
FIG. 3 is a plan view at the time of printing using a ink-jet printer.
Figure 4:
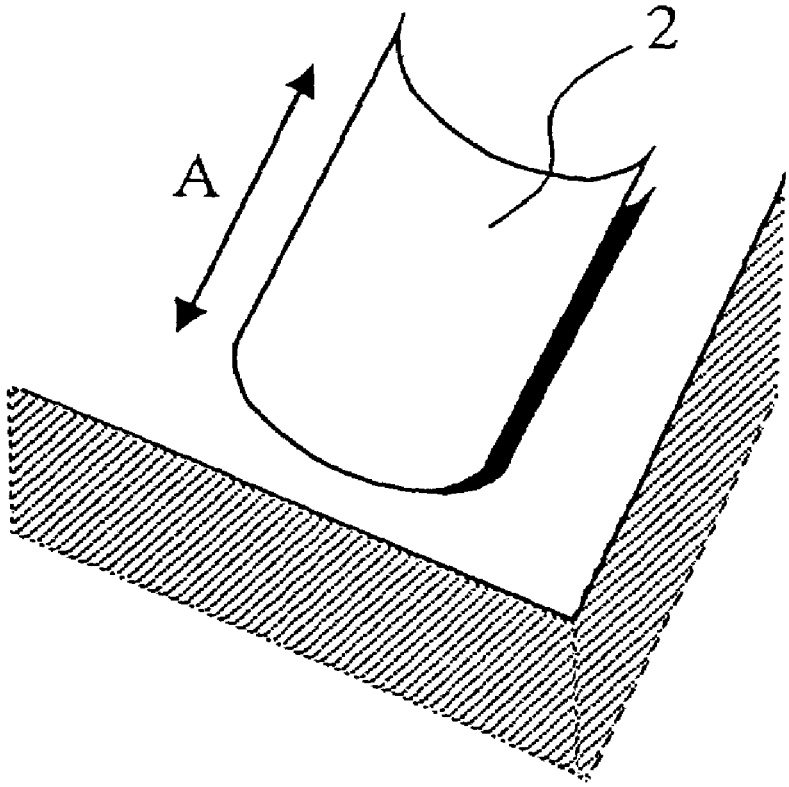
FIG. 4 is a perspective view showing the state of curl of a recording sheet.

FIG. 3 shows a plan view at the time of printing. A printer 3 comprises a paper feeding tray 4, a printing portion 5 and a paper discharging tray 6. At the inside of the printing portion 5, a head 7 is provided so that it scans to a lateral direction. In general, in the case of a paper feeding printer, a paper feeding direction (X) of a recording sheet 2 is a longitudinal direction (A). When a recording material in which an ink-receptive layer mainly containing inorganic fine particles is provided on water-resistant support is cut according to the conventional cutting method as shown in FIG. 2, the recording sheet 2 curls (plus curl) to the direction of the ink-receptive layer side under low humidity conditions. FIG. 4 shows the state of curl of the recording sheet 2. FIG. 4 shows that the recording sheet 2 is shown to be plus curled to the direction which is right angle to the longitudinal direction (A).

Figure 5:
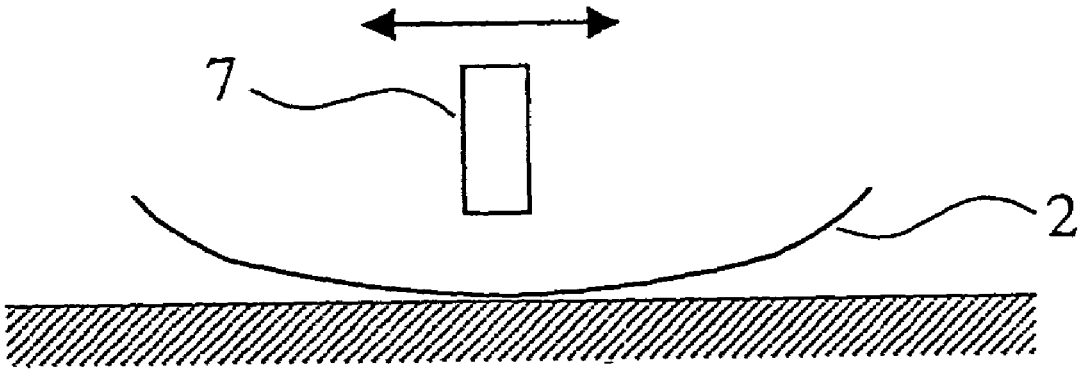
FIG. 5 is a schematic drawing showing a relationship between an ink-jet head of a printer and a recording sheet.

A relationship between a head and a recording sheet is shown in FIG. 5 when the recording sheet curled as shown in FIG. 4 is passed through a printer. The head 7 discharges ink toward the recording sheet 2 while scanning to the directions of arrows. At this time, both edges of the recording sheet 2 rising by curl and the head are contacted to each other to cause head rubbing.

As shown in FIG. 1, the recording sheet cut by the cutting method according to the present invention does not cause curl as mentioned above whereby no head rubbing occurs.

One embodiment of the preparation method of the ink-jet recording material according to the present invention will be explained in detail. A polyolefin resin coated-paper support which was wound in a jumbo roll after coating polyolefin resin layers on the both surfaces of a base paper is previously prepared. A length of the support wound in a jumbo roll herein prepared is 1000 to 5000 m and a width of the same is 100 to 300 cm in general. To the support, an ink-receptive layer containing inorganic fine particles having an average primary particle size of 30 nm or less and a hydrophilic binder is coated and dried, and the material is once wound in a jumbo roll. Next, the jumbo roll on which the ink-receptive layer is coated (the reference numeral 1 in FIG. 1) is cut to a size of a final product at the finishing step (a cutting step). The shape of the final product includes a roll and a sheet, and the present invention is limited to a sheet-state recording material.

As a product size of the recording sheet of the invention, there are a L size (short side 89 mm×long side 127 mm), a 2L size (127 mm×178 mm), a letter size (216 mm×279 mm), an A4 size (210 mm×297 mm), an A3 size (297 mm×420 mm), a B size (279 mm×432 mm), an A3 elongated size (329 mm×483 mm) and the like.

At the finishing step, as shown in FIG. 1, the recording sheet 2 is so cut that the longitudinal direction (A) is a right angle direction to a flowing direction (a continuously rolling direction) (Y) at the time of coating the ink-receptive layer.

In FIG. 1, for the purpose of simple explanation, only one sheet of the recording sheet 2 is shown, but in an actual step, the recording sheet 2 is completely cut to sheets to the flowing direction and the width direction of the jumbo roll 1.

Preferred embodiments of the present invention are explained below. With regard to a winding direction of the support of the jumbo roll, it is preferred that a side on which the ink-receptive layer is to be provided by coating is outside. Moreover, with regard to a winding direction of the material after coating the ink-receptive layer and drying, it is preferred that a side on which the ink-receptive layer is provided is outside. In FIG. 1, the upper surface 8 is a side on which the ink-receptive layer is provided by coating. According to this constitution, head rubbing can be further prevented.

Also, head rubbing in a paper feeding printer likely occurs at the time of using a recording sheet having a length of a longitudinal direction of 300 mm or less, particularly a length of 200 mm or less. Accordingly, in the present invention, remarkable effects can be obtained when it is applied to a relatively small sized product among a number of product sizes.

Next, the ink-receptive layer of the present invention is explained in detail. The inorganic fine particles to be used in the present invention have an average primary particle size of 30 nm or less, preferably 20 nm or less and a lower limit thereof is 3 nm or so. Moreover, an average secondary particle size of the same in which the primary particles are secondary aggregated is preferably within the range of 50 to 300 nm. Such fine particles can impart photo-like high glossiness and high ink absorption property to a recording sheet.

However, such an ink-receptive layer containing inorganic fine particles and a hydrophilic binder shrinks by drying in the course of drying procedure after coating it onto a support. This shrinkage by drying is considered to be caused by a hydrogen bond between the inorganic fine particles and the hydrophilic binder, or binding between the inorganic fine particles (for example, dehydration condensation of silanol groups in the case of silica fine particles). In particular, the above-mentioned shrinkage by drying likely occurs when the primary particle size and the secondary particle size of the inorganic fine particles are smaller. Moreover, it likely occurs when a weight ratio (B/P) of an amount of the hydrophilic binder (B) to an amount of the inorganic fine particles (P) is larger.

As the inorganic fine particles to be used in the present invention, fumed silica and aluminum hydrate are preferably used. Fumed silica to be preferably used in the present invention is also called to as the drying method silica, and it can be generally prepared by a flame hydrolysis method. More specifically, it has been generally known a method in which silicon tetrachloride is burned with hydrogen and oxygen. The fumed silica is commercially available from Nippon Aerosil K.K. (Japan) under the trade name of Aerosil, and K.K. Tokuyama (Japan) under the tradename of QS type, etc. The fumed silica is generally present in the form of secondary particles having a suitable void by aggregation. Thus, it is preferably used by pulverizing or dispersing with ultrasonic wave, a high-pressure homogenizer or a counter collision type jet pulverizer until an average particle size of the secondary particles becomes 50 to 300 nm or so since it gives good ink-absorption property and glossiness.

The aluminum hydrate to be preferably used in the present invention is represented by the structural formula of $Al_2O_3.nH_2O$ (n=1 to 3). When n is 1, it shows aluminum hydrate having a boehmite structure, and when n is larger than 1 and less than 3, it shows aluminum hydrate having a pseudo boehmite structure. It can be prepared by the conventionally known preparation method such as hydrolysis of aluminum alkoxide such as aluminum isopropoxide, etc., neutralization of an aluminum salt by an alkali, hydrolysis of an aluminate, and the like. In the present invention, there may be used, for example, aluminum hydrates as described in Japanese Provisional Patent Publications No. 276671/1990, No. 67684/1991, No. 251488/1991, No. 67986/1992, No. 263983/1992 and No. 16517/1993.

In the present invention, the average primary particle size of the inorganic fine particles can be obtained from an observation by an electron microscope where the particles are dispersed, and for each of 100 particles existing in a predetermined area, a diameter of a circle whose area is equivalent to a projected area of each particle is taken as a particle diameter for that particle. In the present invention, the average secondary particle size is a value in a weight-based average from the data obtained by using a particle size distribution meter in a centrifugal sedimentation system. As a measurement device, there is a device using a disc type high speed centrifugal sedimentation method (for example, Type BI-DCP, trade name, manufactured by Nikkiso Co., Japan).

In the ink-receptive layer of the present invention, the inorganic fine particles are preferably contained in an amount of 8 $g/m^2$ or more, more preferably in the range of 10 to 35 $g/m^2$, further preferably in the range of 15 to 30 $g/m^2$ to heighten ink-absorption property. In the ink-receptive layer of the present invention, a hydrophilic binder is contained in addition to the inorganic fine particles. A weight ratio (B/P) of the hydrophilic binder (B) to the inorganic fine particles (P) is preferably 0.4 or less, more preferably 0.35 or less, particularly preferably 0.3 or less. A lower limit of the (B/P) is 0.05 or so. According to this constitution, a void ratio of the ink-receptive layer becomes high whereby the ink-absorption property is improved. Also, shrinkage by drying of the ink-receptive layer is controlled so that plus curl can be made small.

In the ink-receptive layer of the present invention, the inorganic fine particles are contained in the ink-receptive layer as a main component. That is, the inorganic fine particles are contained in an amount of preferably 50% by weight or more, more preferably 60% by weight or more, further preferably 65% by weight or more based on the total solid component of the ink-receptive layer.

In the present invention, as the hydrophilic binder to be used in combination with the inorganic fine particles, conventionally known various kinds of binders can be used, and a hydrophilic binder having high transparency and having high permeability of ink is preferably used. For using the hydrophilic binder, it is important that the hydrophilic binder does not clog the voids by swelling at the initial stage of permeation of ink. From this point of view, a hydrophilic binder having a relatively low swellability at around the room temperature is preferably used. A particularly preferred hydrophilic binder is a completely or partially saponified polyvinyl alcohol or a cationic-modified polyvinyl alcohol.

Among the polyvinyl alcohols, particularly preferred is partially or completely saponified polyvinyl alcohol having a saponification degree of 80% or more and an average polymerization degree of 200 to 5000. In particular, a polyvinyl alcohol having an average polymerization degree of 2500 to 5000 is preferred, and further a polyvinyl alcohol having an average polymerization degree of 3000 to 5000 is more preferred.

Also, as the cationic-modified polyvinyl alcohol, there may be mentioned, for example, a polyvinyl alcohol having a primary to tertiary amino groups or a quaternary ammonium group at the main chain or side chain of the polyvinyl alcohol as disclosed in Japanese Provisional Patent Publication No. 10483/1986.

In the present invention, plus curl becomes small and head rubbing is difficultly caused by using the above-mentioned hydrophilic binder in combination with a cross-linking agent (hardener), so that such a constitution is preferably used. Specific examples of the hardener may include an aldehyde type compound such formaldehyde and glutaraldehyde; a ketone compound such as diacetyl and chloropentanedione; bis (2-chloroethylurea); 2-hydroxy-4,6-dichloro-1,3,5-triazine; a compound having a reactive halogen as disclosed in U.S. Pat. No. 3,288,775; divinylsulfone; a compound having a reactive olefin as disclosed in U.S. Pat. No. 3,635,718; a N-methylol compound as disclosed in U.S. Pat. No. 2,732,316; an isocyanate compound as disclosed in U.S. Pat. No. 3,103,437; an aziridine compound as disclosed in U.S. Pat. No. 3,017,280 and U.S. Pat. No. 2,983,611; a carbodiimide type compound as disclosed in U.S. Pat. No. 3,100,704; an epoxy compound as disclosed in U.S. Pat. No. 3,091,537; a halogen carboxyaldehyde compound such as mucochloric acid, a dioxane derivative such as dihydroxydioxane, an inorganic hardener such as chromium alum, zirconium sulfate, boric acid and a borate, and they may be used independently or in combination of two or more. Of these, boric acid and a borate are particularly preferred. An amount of the boric acid or a borate is preferably within the range of 1 to 40% by weight, particularly preferably in the range of 5 to 30% by weight based on the amount of the hydrophilic binder.

The respective ink-receptive layers according to the present invention preferably contain a cationic compound for the purpose of improving water resistance of the printed images.

As the cationic compound to be used in the present invention, there may be mentioned, for example, a cationic polymer and a water-soluble metallic compound. As the cationic polymer to be used in the present invention, there may be preferably mentioned polyethyleneimine, polydiallylamine, polyallylamine, polyalkylamine, as well as polymers having a primary to tertiary amino group or a quaternary ammonium group as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/1988, No. 115780/1988, No. 280681/1988, No. 40371/1989, No. 234268/1994, No. 125411/1995 and No. 193776/1998, etc. An average molecular weight (Mw) of these cationic polymers is preferably in the range of 5,000 to 100,000.

An amount of these cationic polymers is preferably 1 to 10% by weight, more preferably, 2 to 7% by weight based on the amount of the inorganic fine particles.

The water-soluble metallic compound to be used in the present invention may include, for example, a water-soluble polyvalent metallic salt. As such a salt, there may be mentioned a water-soluble salt of a metal selected from the group consisting of calcium, barium, manganese, copper, cobalt, nickel, aluminum, iron, zinc, zirconium, titanium, chromium, magnesium, tungsten, and molybdenum. In the present invention, the term "water-soluble" means the compound dissolves in water in an amount of 1% by weight or more under normal temperature and normal pressure. More specifically, such a water-soluble metallic compound may include, for example, calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, amide nickel sulfate tetrahydrate, aluminum sulfate, aluminum sulfite, aluminum thiosulfate, poly(aluminum chloride), aluminum nitrate nonahydrate, aluminum chloride hexahydrate, ferrous bromide, ferrous chloride, ferric chloride, ferrous sulfate, ferric sulfate, zinc bromide, zinc chloride, zinc nitrate hexahydrate, zinc sulfate, titanium chloride, titanium sulfate, zirconium acetate, zirconium chloride, zirconium oxychloride, zirconium hydroxy chloride, zirconium nitrate, basic zirconium carbonate, zirconium hydroxide, ammonium zirconium carbonate, potassium zirconium carbonate, zirconium sulfate, zirconium fluoride, chromium acetate, chromium acetate, chromium sulfate, magnesium sulfate, magnesium chloride hexahydrate, magnesium citrate nonahydrate, sodium phosphorus wolframate, tungsten sodium citrate, dodecawolframatophosphate n hydrate, dodecawolframatosilicate 26 hydrate, molybdenum chloride, dodecamolybdatephosphate n hydrate, etc.

Also, as the cationic compound, there may be mentioned a basic poly(aluminum hydroxide) compound which is an inorganic aluminum-containing cationic polymer. The basic poly(aluminum hydroxide) compound is a water-soluble poly(aluminum hydroxide) a main component of which is represented by the following formula (A), (B) or (C), and which contains a polynuclear condensed ion which is basic and a polymer in a stable form, such as $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

$$[Al_2(OH)_nCl_{6-n}]_m \quad (A)$$

$$[Al(OH)_3]_nAlCl_3 \quad (B)$$

$$Al_n(OH)_mCl_{(3n-m)} \quad 0<m<3n \quad (C)$$

These water-soluble aluminum compounds are commercially available from Taki Chemical, K.K., Japan under the trade name of poly(aluminum chloride) (PAC, trade name) as a water treatment agent, from Asada Chemical K.K., Japan under the trade name of poly(aluminum hydroxide) (Paho, trade name), from K. K. Riken Green, Japan under the trade name of Pyurakemu WT (trade name) and other manufacturers with the same objects whereby various kinds of different grades can be easily obtained. In the present invention, these commercially available products may be used as such. Of these products, there is a product having an unsuitably low pH. In such a case, it may be used by optionally adjusting the pH of the product.

In the present invention, an amount of the above-mentioned water-soluble metallic compound in the ink-receptive layer is preferably about 0.1 g/cm$^2$ to 10.0 g/cm$^2$, more preferably about 0.2 g/cm$^2$ to 5.0 g/cm$^2$.

The above-mentioned cationic compound may be used in combination of two or more kinds. For example, it is preferred to use the cationic polymer and the water-soluble metallic compound in combination.

The ink-receptive layer of the present invention may preferably further contain various kinds of oil droplets to improve brittleness of a film. As such oil droplets, there may be mentioned a hydrophobic organic solvent having a high boiling point (for example, liquid paraffin, dioctyl phthalate, tricresyl phosphate, silicone oil, etc.) or polymer particles (for example, particles in which at least one of a polymerizable monomer such as styrene, butyl acrylate, divinyl benzene, butyl methacrylate, hydroxyethyl methacrylate, etc. is/are polymerized) each having a solubility in water at room temperature of 0.01% by weight or less. Such oil droplets can be used in an amount in the range of 10 to 50% by weight based on the amount of the hydrophilic binder.

In the present invention, to the ink-receptive layer, various kinds of conventionally known additives such as a coloring dye, a coloring pigment, a fixing agent of an ink dye, an UV absorber, an antioxidant, a dispersant of a pigment, an antifoaming agent, a leveling agent, an antiseptic agent, a fluorescent brightener, a viscosity stabilizer, a pH controller, etc. may be further added in addition to the surfactant and the hardener.

In the present invention, the coating method of the ink-receptive layer is not particularly limited, and a coating method conventionally known in the art maybe used. For example, there may be mentioned a slide bead system, a curtain system, an extrusion system, an air knife system, a roll coating system, a rod bar coating system, etc.

In the present invention, the ink-receptive layer may be a single layer or two or more layers. When the ink-receptive layer comprises two or more layers, it is preferred to use a system such as a slide bead system and a curtain coating system, which are capable of coating multiple layers simultaneously. The simultaneous multiple coating is preferred in the points of giving required characteristics to the respective layers with good efficiency and of production efficiency. That is, by laminating the respective layers in wet conditions, the components contained in the respective layers are difficultly impregnated into other layers, so that the respective components in the respective layers can be well maintained in the said layer as designed after drying.

A water-resistant support to be used in the present invention may be mentioned a plastic resin film such as polypropylene, polyvinyl chloride, a diacetate resin, a triacetate resin, cellophane, an acrylic resin, polyethylene terephthalate, polyethylene naphthalate and the like, and a polyolefin resin-coated paper in which both surfaces of a base paper are covered by a polyolefin resin. The present invention can be particularly suitably applied to a recording sheet using a polyolefin resin-coated paper.

A thickness of the support to be used in the present invention is usually 50 to 300 μm or so, preferably 180 λm or more to heighten the feel of a material.

Next, the polyolefin resin-coated paper to be preferably used in the present invention is explained in detail. A base paper constituting the polyolefin resin-coated paper is not particularly limited, and any paper generally used may be employed. More preferably a smooth base paper such as that used as a paper for a photographic support maybe used. As pulp for constituting the base paper, natural pulp, regenerated pulp, synthetic pulp, etc. may be used singly or in combination of two or more in admixture. In the base paper, various kinds of additives conventionally used in the paper-making industry such as a sizing agent, a strengthening additive of paper, a loading material, an antistatic agent, a fluorescent brightener, a dye, etc. may be formulated.

Moreover, a surface sizing agent, a surface strengthening additive of paper, a fluorescent brightener, an antistatic agent, a dye, an anchoring agent, etc. may be coated on the surface of the paper.

A thickness of the base paper is not particularly limited, and preferably that having a good surface smoothness prepared by compressing paper during paper-making or after paper-making by applying pressure using a calender, etc. A basis weight thereof is preferably 30 to 250 g/m$^2$.

As the polyolefin resin to be used in the polyolefin resin layer, there may be mentioned a homopolymer of an olefin such as low density polyethylene, high density polyethylene, polypropylene, polybutene, polypentene, etc.; a copolymer comprising two or more olefins such as an ethylene-propylene copolymer, etc.; or a mixture thereof, and these polymers having various densities and melt viscosity indexes (melt index) may be used singly or in combination of two or more.

Also, to the polyolefin resin layer, various kinds of additives including a white pigment such as titanium oxide, zinc oxide, talc, calcium carbonate, etc.; an aliphatic amide such as stearic amide, arachidamide, etc.; an aliphatic acid metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc.; a magenta-color pigment or dye such as cobalt violet, fast violet, manganese violet, etc.; a fluorescent brightener, an UV absorber, etc. may be preferably added by optionally combining two or more.

The polyolefin resin-coated paper can be generally prepared by extruding a melted polyolefin resin under heating between a base paper and a cooling roller in a film state by an extruder, and adhering by pressure and cooling by the cooling roller. Also, it is preferred to carry out an activation treatment to a base paper before coating the polyolefin resin to the base paper, such as a corona discharge treatment, a flame treatment, etc. A thickness of the polyolefin resin layer is preferably in the range of 5 to 50 μm.

In the present invention, preferred polyolefin resin-coated paper has a basis weight of the base paper in the range of 100 to 250 g/m$^2$, and a thickness of the polyolefin resin layer is preferably in the range of 20 to 40 μm. More preferably, the basis weight of the base paper is in the range of 150 to 220 g/m$^2$, and a thickness of the polyolefin resin layer is in the range of 25 to 35 μm.

As the polyolefin resin of the polyolefin resin layer, a polyethylene resin is preferably used. In particular, for the polyethylene resin layer on which an ink-receptive layer is to be provided, a low density polyethylene resin having a density of 0.930 g/m$^3$ or less is preferably used in an amount of 90% by weight or more, more preferably substantially 100% by weight based on the total resin. Also, as the polyethylene resin layer provided on the surface opposite to the surface on which the ink-receptive layer is to be provided, a high density poly-ethylene resin having a density of 0.950 g/m$^3$ or more is preferably used in an amount of 30% by weight or more, more preferably 50% by weight or more based on the total resin, and an upper limit thereof is 95% by weight or so. By using such a polyethylene resin-coated paper support, plus curl can be further prevented.

A water content of the polyolefin resin-coated paper to be used in the present invention is preferably 6% by weight or more and an upper limit thereof is 9% by weight or so, more preferably in the range of 6.5% by weight to 9.0% by weight. As a method of controlling the water content of the polyolefin resin-coated paper, a method of regulating it at the time of drying a base paper by a dryer when preparing the base paper or regulating it by passing through a humidity controlling zone after completion of the drying.

Plus curl can be further prevented by using a polyvinyl alcohol having a polymerization degree of 2500 or more, more preferably 3000 or more and boric acid or a borate in combination in an ink-receptive layer when the ink-receptive layer is provided on a polyolefin resin-coated paper support having a water content of 6% or more.

To the polyolefin resin-coated paper to be used in the present invention is preferably provided a subbing layer (which is also called to as "a primer layer") on the surface on which an ink-receptive layer is provided by coating. This subbing layer is previously provided by coating on the surface of the polyolefin resin layer before providing the ink-receptive layer by coating. This subbing layer mainly contains a water-soluble polymer or a polymer latex which is capable of forming a film. It is preferably a water-soluble polymer such as gelatin, polyvinyl alcohol, polyvinyl pyrrolidone, a water-soluble cellulose and the like, particularly preferably gelatin. Moreover, a surfactant or a hardener is preferably added to the subbing layer.

The subbing layer is important to strengthen adhesion between the polyolefin resin-coated paper support and the ink-receptive layer. A coated amount of the subbing layer is, however, designed by considering cracking at the time of drying after coating the ink-receptive layer mainly containing inorganic fine particles, and the above-mentioned plus curl. That is, in the present invention, an amount of the subbing layer is preferably 500 mg/m$^2$ or less, and a lower limit thereof is 10 mg/m$^2$ or so in a solid content, more preferably in the range of 20 to 300 mg/m$^2$. By providing such a subbing layer, cracking of the ink-receptive layer can be prevented and enhancement of plus curl can be also prevented. Before coating the subbing layer on the polyolefin resin-coated paper support, it is preferred to treat the support with a corona discharge treatment.

In the present invention, various kinds of back coating layers may be provided by coating to the above-mentioned support for the purpose of antistatic property, feeding and conveying property, curl preventive property and the like. To the back coating layer, an inorganic antistatic agent, an organic antistatic agent, a water-soluble polymer, a polymer latex, a curing agent, a pigment such as colloidal silica, a surfactant and the like may be added in optional combination. An amount of the back coating layer to be coated is preferably 2 g/m$^2$ or less, more preferably 1.5 g/m$^2$ or less in a solid content.

When an ink-receptive layer is provided on a polyolefin resin-coated paper support, it is preferred to carry out a corona discharge treatment, flame treatment, UV ray irradiation treatment, plasma treatment and the like prior to provision of the coating.

EXAMPLES

In the following, the present invention is explained in more detail by referring to Examples, but the present invention is not limited by these Examples. Incidentally, all "part(s)" means "part(s) by weight".

<Preparation of Ink-jet Recording Material A>

<Preparation of Polyolefin Resin-coated Paper Support>

First, a base paper was prepared as mentioned below.

A mixture of a bleached kraft pulp of hardwood (LBKP) and a bleached sulfite pulp of hardwood (NBSP) with a weight ratio of 1:1 was subjected to beating until it becomes 300 ml by the Canadian Standard Freeness to prepare a pulp slurry. To the slurry were added alkyl ketene dimer in an amount of 0.5% by weight based on the amount of the pulp as a sizing agent, polyacrylamide in an amount of 1.0% by weight based on the same as a strengthening additive of paper, cationic starch in an amount of 2.0% by weight based on the same, and a polyamide epichlorohydrin resin in an amount of 0.5% by weight based on the same, and the mixture was diluted with water to prepare a 1% by weight slurry. This slurry was made paper by a tourdrinier paper machine to have a basis weight of 170 g/m$^2$, dried and subjected to moisture conditioning to prepare a base paper for a polyolefin resin-coated paper.

Next, to the thus prepared base paper was coated firstly a polyethylene resin layer on a side on which an ink-receptive layer is to be coated. A polyethylene resin composition comprising 100% by weight of a low density polyethylene having a density of 0.918 g/cm$^3$ and 10% by weight of anatase type titanium oxide dispersed uniformly in the resin was melted at 320° C. and the melted resin composition was subjected to extrusion coating on the above-mentioned base paper with a thickness of 35 μm by 200 m/min and subjected to extrusion coating by using a cooling roller subjected to slightly roughening treatment to provide a front resin layer. Next, on the other surface of the base paper, a blended resin composition comprising 70 parts by weight of a high density polyethylene resin having a density of 0.962 g/cm$^3$ and 30 parts by weight of a low density polyethylene resin having a density of 0.918 g/cm$^3$ was melted similarly at 320° C. and the melted resin composition was subjected to extrusion coating with a thickness of 30 μm and subjected to extrusion coating by using a cooling roller subjected to roughening treatment to provide a back resin layer. A water content of the polyolefin resin-coated paper support was 8%.

Onto the polyethylene resin layer at the side on which an ink-receptive layer is to be provided by coating of the thus prepared polyolefin resin-coated paper support was subjected to a high frequency corona discharge treatment, and then, a coating solution for forming a subbing layer having the following composition was coated thereon to have a gelatin amount of 50 mg/m$^2$ and dried to prepare a support wound in a jumbo roll so that the side to which the ink-receptive layer is to be provided was outside.

<Subbing Layer>

| | |
|---|---|
| Lime-treated gelatin | 100 parts |
| Sulfosuccinic acid-2-ethyl hexyl ester salt | 2 parts |
| Chromium alum | 10 parts |

A coating liquid for an ink-receptive layer having the composition mentioned below was coated on the surface of the above-mentioned support by a slide bead coating device and dried, and the coated material was wound in a jumbo roll so that the ink-receptive layer-coated surface became outside to prepare an ink-jet recording material A. Incidentally, the fumed silica which is an inorganic fine particle was used after dispersing by a high pressure homogenizer with a solid concentration of 20% by weight. Also, a thickness of the coating layer after drying was so provided to be 40 μm (a coated amount of the fumed silica of 19 g/m$^2$) by coating. The drying conditions were that the coated material was cooled at 5° C. for 30 seconds, dried at 45° C. and 10% RH (relative humidity) until a concentration of the total solid content became 90% by weight, and then, at 35° C. and 10% RH. A weight ratio (B/P) of the hydrophilic binder to the inorganic fine particles of this coating liquid was 0.25.

<Coating Liquid A for Ink-receptive Layer>

| | |
|---|---|
| Fumed silica (Average primary particle size: 7 nm, average secondary particle size: 150 nm) | 100 parts |
| Dimethyldiallyl ammonium chloride homopolymer | 4 parts |
| Boric acid | 4 parts |
| Polyvinyl alcohol (Saponification degree: 88%, average polymerization degree: 3500) | 25 parts |
| Surfactant | 0.3 part |

<Preparation of Ink-jet Recording Material B>

In the same manner as in the preparation of the ink-jet recording material A except for changing a coating liquid for preparing an ink-jet recording layer to the composition as mentioned below, an ink-jet recording material B was prepared. A weight ratio (B/P) of the hydrophilic binder to the inorganic fine particles of this coating liquid was 0.20. A coated amount of aluminum hydrate was 26 g/m$^2$.

<Coating Liquid B for Ink-receptive Layer>

| | |
|---|---|
| Alumina hydrate (Average primary particle size: 15 nm, platy shape with an aspect ratio of 5, average secondary particle size: 150 nm) | 100 parts |
| Boric acid | 4 parts |
| Polyvinyl alcohol (Saponification degree: 88%, average polymerization degree: 3500) | 20 parts |
| Surfactant | 0.3 part |

<Preparation of Ink-Jet recording Material C>

In the same manner as in the preparation of the ink-jet recording material A except for changing a coating liquid for preparing an ink-jet recording layer to the composition as mentioned below, an ink-jet recording material C was prepared. A weight ratio (B/P) of the hydrophilic binder to the inorganic fine particles of this coating liquid was 0.42. A coated amount of the fumed silica was 17 g/m$^2$.

<Coating Liquid C for Ink-receptive Layer>

| | |
|---|---|
| Fumed silica (Average primary particle size: 7 nm, average secondary particle size: 150 nm) | 100 parts |
| Dimethyldiallyl ammonium chloride homopolymer | 4 parts |
| Boric acid | 4 parts |
| Polyvinyl alcohol (Saponification degree: 88%, average polymerization degree: 3500) | 42 parts |
| Surfactant | 0.3 part |

<Preparation of Ink-jet Recording Material D>

In the same manner as in the preparation of the ink-jet recording material A except for not using boric acid which is a hardener, an ink-jet recording material D was prepared.

<Preparation of Ink-jet Recording Material E>

In the same manner as in the preparation of the ink-jet recording material A except that a winding direction of the support and a winding direction of the ink-jet recording material were reversed, an ink-jet recording material E was prepared. That is, a support was wound so that a side on which the ink-receptive layer is to be coated becomes inside, an ink-receptive layer was coated and dried, and the coated material was wound so that the ink-receptive layer-coated surface became inside.

<Preparation of Ink-jet Recording Material F>

In the same manner as in the preparation of the ink-jet recording material A except that a ratio of the high-density polyethylene resin in the polyethylene resin layer at the surface opposite to the ink-receptive layer-coated surface of the polyolefin resin-coated paper support was changed to 20% by weight, an ink-jet recording material F was prepared.

<Preparation of Ink-jet Recording Material G>

As a support, a base paper for the above-mentioned polyethylene resin-coated paper was used. This base paper is a support having no polyolefin resin layer. On to the support was coated a coating liquid for an ink-receptive layer having the composition mentioned below by an air knife coater so that a coated amount (as a solid content) became 12 g/m$^2$ and dried. Next, on the ink-receptive layer, a coating liquid for glossiness developing layer was coated by an air knife coater so that a coated amount (as a solid content) became 5 g/m$^2$ and closely contacted to a mirror surface drum having a surface temperature of 100° C. and dried, and peeled off to obtain an ink-jet recording material G. A weight ratio (B/P) of the hydrophilic binder to the inorganic fine particles of this coating liquid was 0.30.

<Coating Liquid D For Ink-receptive Layer>

| | |
|---|---|
| Wet type synthetic silica (Average primary particle size: 15 nm, average secondary particle size: 4 μm) | 100 parts |
| Polyvinyl alcohol (Saponification degree: 98%, average polymerization degree: 1700) | 30 parts |
| Acrylamide cationic polymer | 15 parts |

<Coating Liquid For Glossiness Developing Layer>

| | |
|---|---|
| Colloidal silica (Average primary particle size: 40 nm) | 100 parts |
| Polyvinyl alcohol (Saponification degree: 98%, average polymerization degree: 1700) | 10 parts |
| Acrylamide cationic polymer | 15 parts |
| Acryl-styrene copolymer | 30 parts |
| Releasing agent | 2 parts |

<Preparation of Ink-jet Recording Material H>

In the same manner as in the preparation of the ink-jet recording material A except that the support was changed to a base paper for the above-mentioned polyethylene resin-coated paper. This base paper is a support having no polyolefin resin layer. Thus, an ink-jet recording material H was prepared.

The thus prepared eight kinds of the ink-jet recording materials wound in a jumbo roll were subjected to cutting treatment to L-size (89 mm×127 mm) recording sheets in a finishing step. For subjecting to this cutting treatment, a cutting method of the present invention shown in FIG. 1 and the conventional cutting method shown in FIG. 2 were used. With regard to sixteen kinds of recording sheets thus prepared, head rubbing and photo-like property were evaluated as mentioned below. The evaluated results are shown in Table 1.

<Photo-like Property>

An image of nature was printed on the respective recording materials by using an ink-jet printer, PM-900C (trade name) manufactured by SEIKO EPSON CO. and compared them with a photography (photographic printed paper) of the same image of nature. Glossiness and the feel of a material (a feel of touching) were evaluated by feeling with the following standards.

○: Printed image is comparable to the photography in the feel of a material and glossiness.

Δ: Printed image is slightly lower than the photography in the feel of a material and glossiness.

X: Printed image is clearly inferior to the photography in the feel of a material and glossiness.

<Head Rubbing>

The recording materials were moisture conditioned under the circumstance of 13° C., 35% RH for 8 hours. Thereafter, under the same conditions, black solid printing without edge was carried out each 20 sheets×5 sets, i.e., total 100 sheets by using an ink-jet printer (manufactured by EPSON CO., PM-780C, trade name), and the situation of head rubbing was observed with naked eyes and evaluated by the following standards.

⊙: No head rubbing for all 100 sheets.

○: Slight head rubbing which does not cause any effect on the printed portion was observed in a part of 100 sheets.

ΔA: Head rubbing in which the printed portion became dirt occurred within 10 sheets among 100 sheets.

X: Head rubbing in which the printed portion became dirt occurred more than 10 sheets among 100 sheets, and at worst, scanning of the head stopped.

TABLE 1

| Ink-jet recording material | Cutting method | Photo-like property | Head rubbing | Remarks |
|---|---|---|---|---|
| A | FIG. 1 | ⊙ | ⊙ | Present invention |
| A | FIG. 2 | ⊙ | Δ | Comparative example |
| B | FIG. 1 | ⊙ | ⊙ | Present invention |
| B | FIG. 2 | ⊙ | Δ | Comparative example |
| C | FIG. 1 | ⊙ | ○ | Present invention |
| C | FIG. 2 | ⊙ | X | Comparative example |
| D | FIG. 1 | ⊙ | ○ | Present invention |
| D | FIG. 2 | ⊙ | X | Comparative example |
| E | FIG. 1 | ⊙ | ○ | Present invention |
| E | FIG. 2 | ⊙ | X | Comparative example |
| F | FIG. 1 | ⊙ | ○ | Present invention |
| F | FIG. 2 | ⊙ | X | Comparative example |
| G | FIG. 1 | Δ | X | Comparative example |
| G | FIG. 2 | Δ | X | Comparative example |
| H | FIG. 1 | X | X | Comparative example |
| H | FIG. 2 | X | X | Comparative example |

As can be seen from Table 1, it can be understood that the recording sheets wherein the ink-jet recording materials A to F were cut by the cutting method shown in FIG. 1 according to the present invention cause no dirt in head and are excellent in photo-like properties. To the contrary, the recording sheets wherein the ink-jet recording materials A to F were cut by the conventional cutting method shown in FIG. 2 caused head rubbing. In the ink-jet recording materials G and H, since paper was used as a support, cockling occurred after printing and photo-like properties thereof were clearly inferior to those of the present invention, and head rubbing frequently occurred due to the effect of cockling.

According to the present invention, a recording sheet having high feeling of a material (a feeling of touch) and glossiness similar to those of photography and causing no head rubbing at the time of printing can be obtained.

The invention claimed is:

1. A process for preparing an ink-jet recording material having a water-resistant support and at least one ink-receptive layer provided on the support by cutting to a sheet-state, which comprises cutting, before printing with a printer, the ink-jet recording material wherein the water-resistant support is a polyolefin resin-coated paper support and at least one of the ink-receptive layers contains inorganic fine particles having an average primary particle size of 30 nm or less in an amount of 8 $g/m^2$ or more and a hydrophilic binder such that a longitudinal direction of the ink-jet recording material is at a right angle to a flowing direction of the recording material at a time of coating the ink-receptive layer.

2. The process for preparing an ink-jet recording material according to claim 1, wherein the inorganic fine particles are contained in the ink-receptive layer in an amount of 50% by weight or more based on the total solid content of the ink-receptive layer.

3. The process for preparing an ink-jet recording material according to claim 1, wherein the inorganic fine particles are contained in the ink-receptive layer in an amount of 60% by weight or more based on the total solid content of the ink-receptive layer.

4. The process for preparing an ink-jet recording material according to claim 1, wherein the ink-receptive layer contains the inorganic fine particles in an amount of 10 to 30 $g/m^2$.

5. The process for preparing an ink-jet recording material according to claim 1, wherein the inorganic fine particles have an average secondary particle size of 50 to 300 nm.

6. The process for preparing an ink-jet recording material according to claim 1, wherein the inorganic fine particles are at least one selected from the group consisting of fumed silica and aluminum hydrate.

7. The process for preparing an ink-jet recording material according to claim 1, wherein a weight ratio of the hydrophilic binder to the inorganic fine particles is 0.4 or less.

8. The process for preparing an ink-jet recording material according to claim 1, wherein the ink-receptive layer contains a hardener of the hydrophilic binder.

9. The process for preparing an ink-jet recording material according to claim 8, wherein the hardener is boric acid or a borate.

* * * * *